US007887127B1

(12) United States Patent
Albritton

(10) Patent No.: US 7,887,127 B1
(45) Date of Patent: Feb. 15, 2011

(54) COUPLE'S CHAIR

(76) Inventor: William J. Albritton, P.O. Box 20932, Jackson, MS (US) 39289-0932

( * ) Notice: Subject to any disclaimer, the term of this patent is extended or adjusted under 35 U.S.C. 154(b) by 0 days.

(21) Appl. No.: 12/542,482

(22) Filed: Aug. 17, 2009

Related U.S. Application Data

(63) Continuation-in-part of application No. 29/308,842, filed on Jul. 9, 2008, now Pat. No. Des. 598,208, which is a continuation-in-part of application No. 29/265,230, filed on Aug. 28, 2006, now abandoned, which is a continuation-in-part of application No. 29/176,470, filed on Apr. 16, 2003, now abandoned.

(51) Int. Cl.
*A47C 15/00* (2006.01)

(52) U.S. Cl. ..... 297/245

(58) Field of Classification Search ..... 297/245, 297/230.14, 411.4, 297, 67, 77, 463.2, 354.1; 600/38; 128/845
See application file for complete search history.

(56) References Cited

U.S. PATENT DOCUMENTS

| | | | | |
|---|---|---|---|---|
| 307,811 | A | 11/1884 | Smith | |
| 715,668 | A | 12/1902 | Kiddie | |
| 1,312,382 | A | 8/1919 | Benas | |
| D211,461 | S | 6/1968 | Walkinshaw | |
| D274,482 | S | 7/1984 | Caldwell | |
| D283,378 | S | 4/1986 | Opsvik | |
| 4,607,882 | A | 8/1986 | Opsvik | |
| D291,155 | S | 8/1987 | Wertheimer | |
| D292,455 | S | 10/1987 | Rykken | |
| 4,699,423 | A | 10/1987 | Fitzig et al. | |
| 5,137,332 | A * | 8/1992 | Gualtierotti et al. | 297/440.15 |
| 5,377,943 | A | 1/1995 | Perl | |
| 5,385,154 | A | 1/1995 | Fuhrman et al. | |
| 5,389,062 | A | 2/1995 | Mitchum, Jr. | |
| 5,542,743 | A | 8/1996 | Olson et al. | |
| 5,586,808 | A * | 12/1996 | Oelke | 297/287 |
| 5,868,460 | A * | 2/1999 | Christensen | 297/62 |
| 6,338,344 | B1 | 1/2002 | Sinohui, Jr. | |
| D499,895 | S | 12/2004 | Olson et al. | |
| D514,338 | S | 2/2006 | Bellin | |
| D517,820 | S | 3/2006 | Citterio | |
| D520,764 | S | 5/2006 | Kinoshita et al. | |
| 7,114,777 | B2 | 10/2006 | Knoblock et al. | |
| D536,890 | S | 2/2007 | Loew et al. | |
| D543,041 | S | 5/2007 | Hara | |
| D543,369 | S | 5/2007 | Hara | |
| D546,594 | S | 7/2007 | Kane et al. | |
| D567,523 | S | 4/2008 | Hara | |
| D568,625 | S | 5/2008 | Klaasen, II et al. | |

FOREIGN PATENT DOCUMENTS

| | | | |
|---|---|---|---|
| DE | 29620557 | U1 * | 3/1998 |
| DE | 202008010073 | U1 * | 1/2009 |
| GB | 2046797 | S | 8/1995 |
| GB | 3019984 | S | 8/2005 |

* cited by examiner

*Primary Examiner*—Milton Nelson, Jr.
(74) *Attorney, Agent, or Firm*—Walker, McKenzie & Walker, P.C.

(57) ABSTRACT

A chair for supporting a couple. The chair has first and second backrests mounted to the seat of the chair for movement from a substantially upright first position to a tilted second position at an angle with respect to the first position. A couple sits facing each other in the chair, one member of the couple being seated in the lap of the other, each member of the couple being respectively supported by their respective backrest, allowing the couple to rock back and forth while seated in the chair.

2 Claims, 7 Drawing Sheets

COUPLE'S CHAIR

CROSS REFERENCE TO RELATED APPLICATIONS

This application is a continuation-in-part of U.S. Design patent application No. 29/308,842 (filed Jul. 9, 2008; now issued as U.S. Design patent Des. 598,208 (issued Aug. 18, 2009)), which, in turn, was a continuation-in-part of U.S. Design patent application No. 29/265,230 (filed Aug. 28, 2006; now abandoned), which, in turn, was a continuation-in-part of U.S. Design patent application No. 29/176,470 (filed Apr. 16, 2003; now abandoned).

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to furniture, and in particular, to furniture on which a couple may be seated.

2. Information Disclosure Statement

It is often desired to have furniture on which a couple may be seated together. It is further well-known to have adjustable height pedestal-type chairs that sit upon a base with a plurality of casters. Well-known solutions for this problem include sofas, benches, love seats, and rolling chairs suitable for an office. However, such furniture does not allow a couple to sit facing each other while providing support for the backs of both members of the couple.

It is therefore desirable to have a couple's chair upon which a couple can sit facing each other, in which the chair provides support for the backs of both members of the couple.

The following prior art patents are known, some of which may be relevant to the present invention: Walkinshaw, U.S. Pat. No. Des. 211,461 (issued Jun. 18, 1968); Caldwell, U.S. Pat. No. Des. 274,482 (issued Jul. 3, 1984); Opsvik, U.S. Pat. No. Des. 283,378 (issued Apr. 15, 1986); Wertheimer, U.S. Pat. No. Des. 291,155 (issued Aug. 4, 1987); Rykken, U.S. Pat. No. Des. 292,455 (issued Oct. 27, 1987); Olson et al., U.S. Pat. No. Des. 499,895 (issued Dec. 21, 2004); Bellin, U.S. Pat. No. Des. 514,338 (issued Feb. 7, 2006); Citterio, U.S. Pat. No. Des. 517,820 (issued Mar. 28, 2006); Kinoshita et al., U.S. Pat. No. Des. 520,764 (issued May 16, 2006); Loew et al., U.S. Pat. No. Des. 536,890 (issued Feb. 20, 2007); Hara, U.S. Pat. No. Des. 543,041 (issued May 22, 2007); Hara, U.S. Pat. No. Des. 543,369 (issued May 29, 2007); Kane et al., U.S. Pat. No. Des. 546,594 (issued Jul. 17, 2007); Hara, U.S. Pat. No. Des. 567,523 (issued Apr. 29, 2008); Klaasen, II et al., U.S. Pat. No. Des. 568,625 (issued May 13, 2008); Smith, U.S. Pat. No. 307,811 (issued Nov. 11, 1884); Kiddie, U.S. Pat. No. 715,668 (issued Dec. 9, 1902); Benas, U.S. Pat. No. 1,312,382 (issued Aug. 5, 1919); Opsvik, U.S. Pat. No. 4,607,882 (issued Aug. 26, 1986); Fitzig et al., U.S. Pat. No. 4,699,423 (issued Oct. 13, 1987); Perl, U.S. Pat. No. 5,377,943 (issued Jan. 3, 1995); Fuhrman et al., U.S. Pat. No. 5,385,154 (issued Jan. 31, 1995); Mitchum, Jr., U.S. Pat. No. 5,389,062 (issued Feb. 15, 1995); Olson et al., U.S. Pat. No. 5,542,743 (issued Aug. 6, 1996); Sinohui, Jr., U.S. Pat. No. 6,338,344 (issued Jan. 15, 2002); Knoblock et al., U.S. Pat. No. 7,114,777 (issued Oct. 3, 2006); Protoned B.V., United Kingdom Design Patent No. 2,046,797 (issued Aug. 9, 1995); and Stoll Giroflex AG, United Kingdom Design Patent No. 3,019,984 (issued Aug. 9, 2005).

None of these references, either singly or in combination, discloses or suggests the present invention.

BRIEF SUMMARY OF THE INVENTION

The present invention is a couple's chair upon which a couple can sit facing each other, in which the chair provides support for the backs of both members of the couple.

It is an object of the present invention to provide a couple's chair upon which a couple can sit facing each other, in which the chair provides support for the backs of both members of the couple.

DETAILED DESCRIPTION OF THE INVENTION

Figure 1:
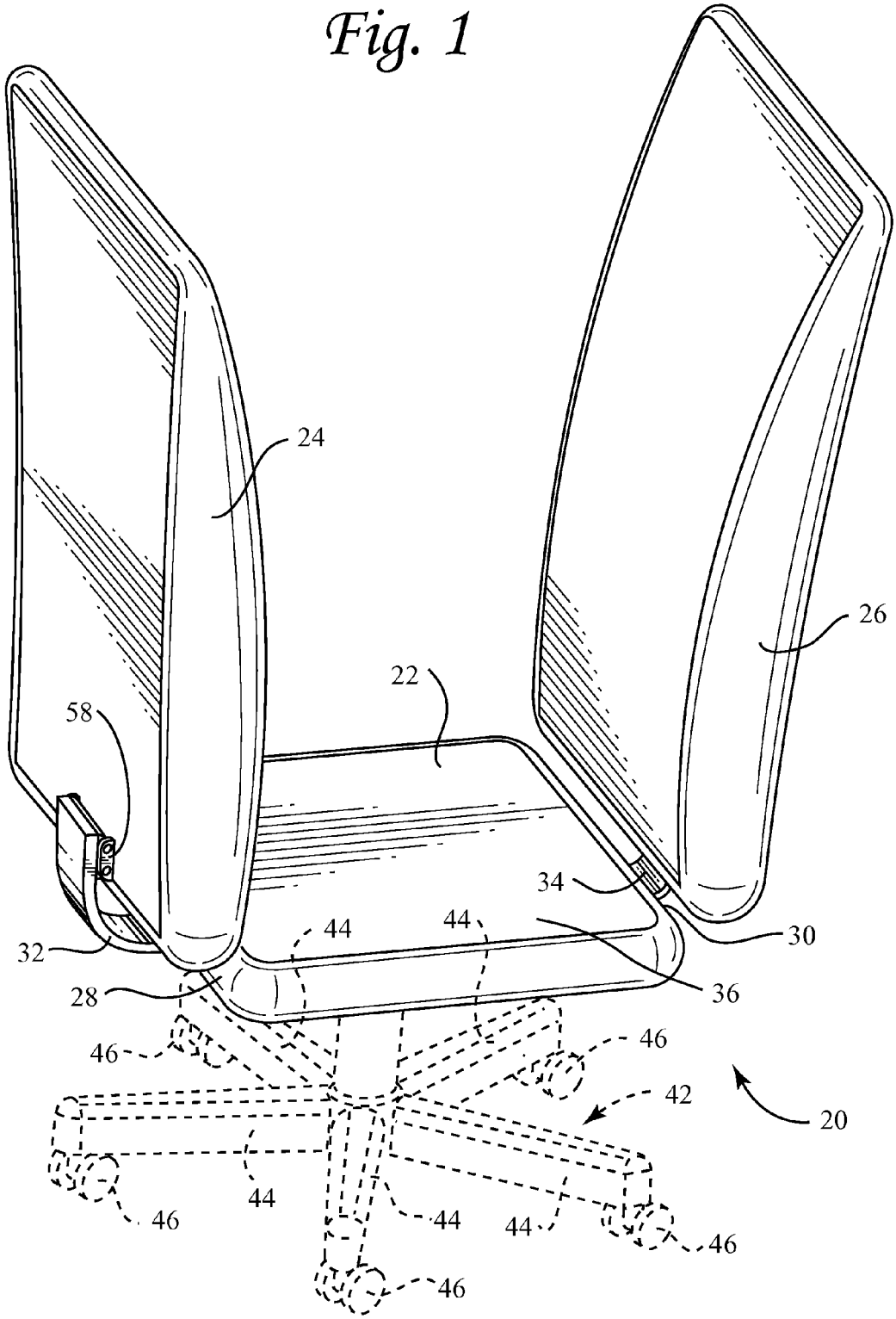
FIG. 1 is a perspective view of the couple's chair of the present invention with a well-known pedestal base shown in dotted outline.
Figure 2:
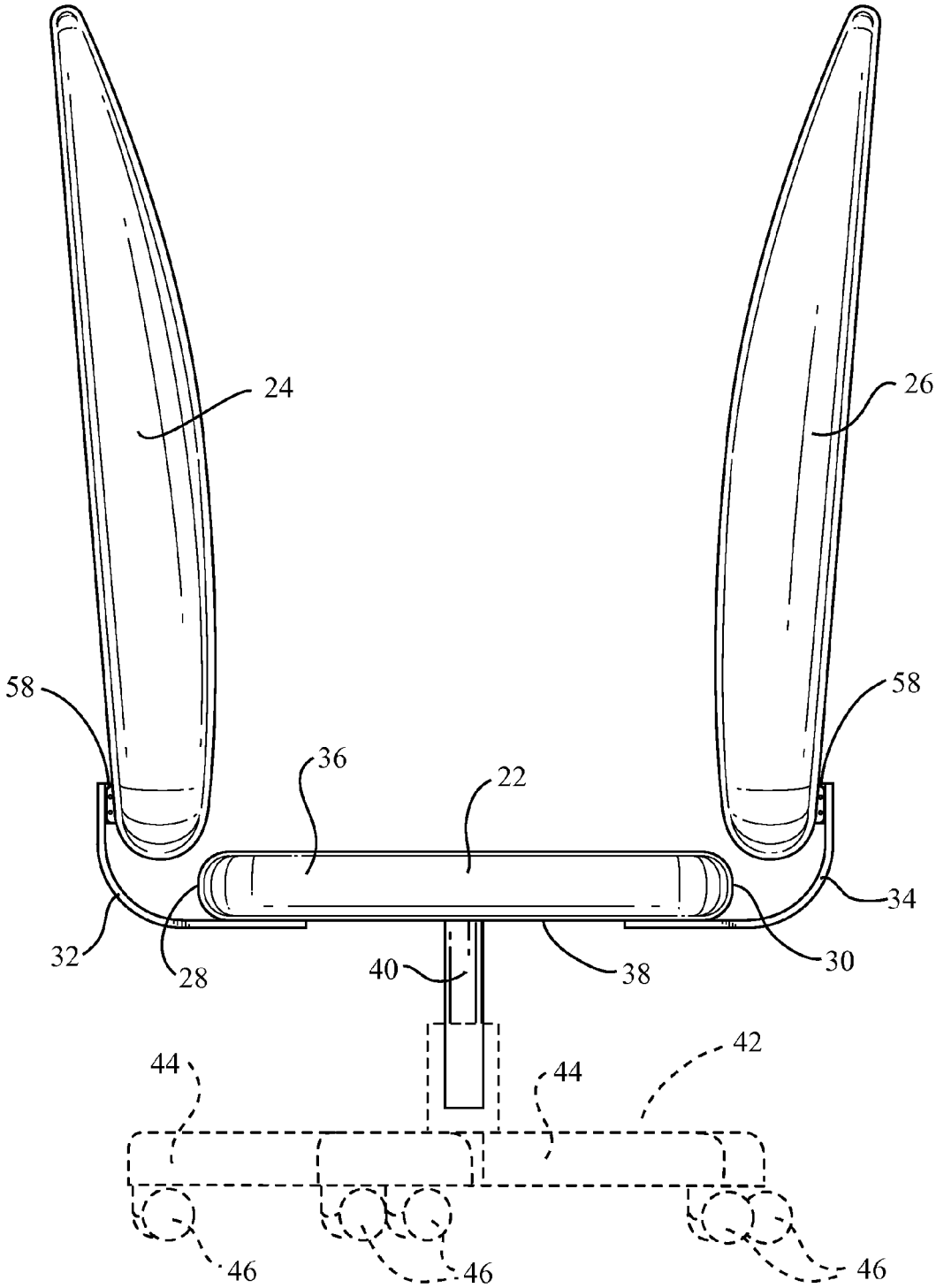
FIG. 2 is a side view of the couple's chair of the present invention with a well-known pedestal base shown in dotted outline.

Referring to FIGS. 1-7, couple's chair 20 is seen to comprise a seat 22 and first and second backrests 24, 26. Seat 22 is preferably generally rectangular as shown, and has a first lateral edge 28 and a second lateral edge 30, with first and second edges 28, 30 being opposed to each other on non-adjacent side of seat 22.

First backrest 24 is mounted to seat 22 and is upstanding adjacent first lateral edge 28 and, in a similar manner, second backrest 26 is mounted to seat 22 and is upstanding adjacent second lateral edge 30. First and second backrests 24, 26 are preferably padded in a manner well-known to those skilled in the art for comfort of the couple sitting in chair 20.

Chair 20 also comprises a first backrest support 32 mounting first backrest 24 to seat 22 and a second backrest support 34 mounting second backrest 26 to seat 22. The structure of first and second backrest supports 32, 34 is substantially similar, and a description of second backrest support 34, and its attachment to seat 22 and second backrest 26, shall be understood to suffice for first backrest support 32 and its respective attachment to seat 22 and first backrest 24.

Backrest support 34, like backrest support 32, is preferably constructed of a flexible piece of spring steel selected to support the weight of the couple when they are mutually and conjoinedly seated in the chair 20 and both exerting pressure against either or both of the backrests.

Seat 22 preferably includes a padded seat cushion 36, padded in a manner well-known to those skilled in the art for the seating comfort of the couple when they are seated in chair 20, and seat 22 further preferably includes a supporting base 38 supportingly mounted to the underside of seat 22, with base 38 preferably including a post 40 fixedly mounted thereto in a manner well-known to those skilled in the art and downwardly depending for insertion into a well-known pedestal base 42. Pedestal base 42 preferably has a plurality of outwardly-extending legs 44, each leg 44 including a well-known caster 46 for rolling movement of chair 20 over a surface such as a floor.

Each respective backrest support 32, 34 is preferably secured to the underside of seat 22 as by a plurality of rivets or preferably screws 48 passing through holes 50 in the respective backrest support 32, 34 and then being anchored into seat 22 as by being threadedly secured into holes 52 provided in supporting seat base 38. It should be understood that first and second backrest supports 32, 34 may be integrally formed with seat 22 and/or first and second backrest supports 32, 34 may be joined together or formed from a single piece of spring steel without departing from the scope of the present invention.

Each respective backrest support 32, 34 is further preferably secured to its respective backrest 24 or 26 as by a plurality of pins 54 through a flange 56 on respective backrest supports 32, 34 that engage mating flanges 58 on respective backrests 24, 26, with pins 54 passing through holes 59 within flange 56 and being entrappingly held therein.

Figure 3:
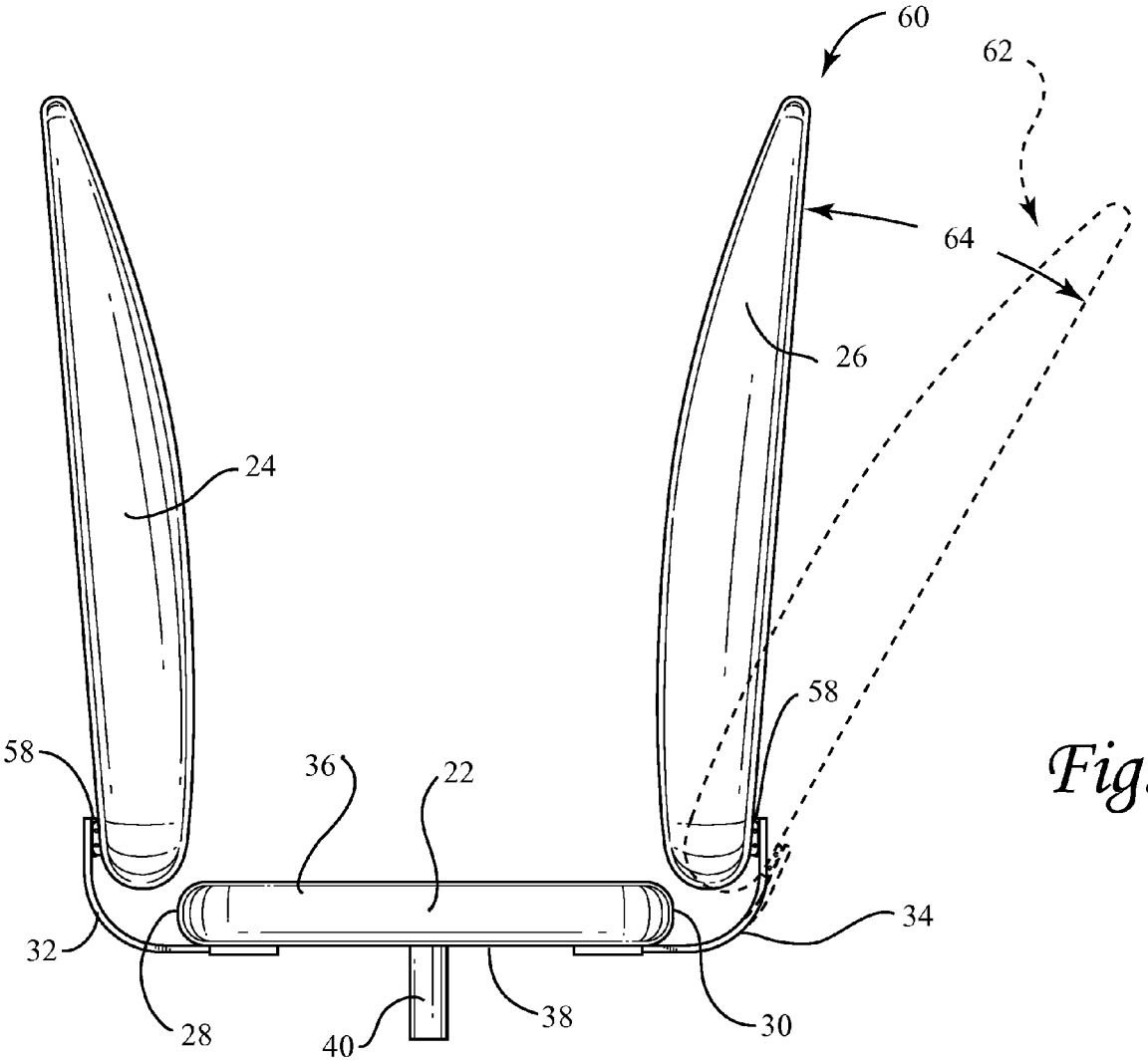
FIG. 3 is a side view of the couple's chair of the present invention showing movement of one of the chair backrests.
Figure 4:
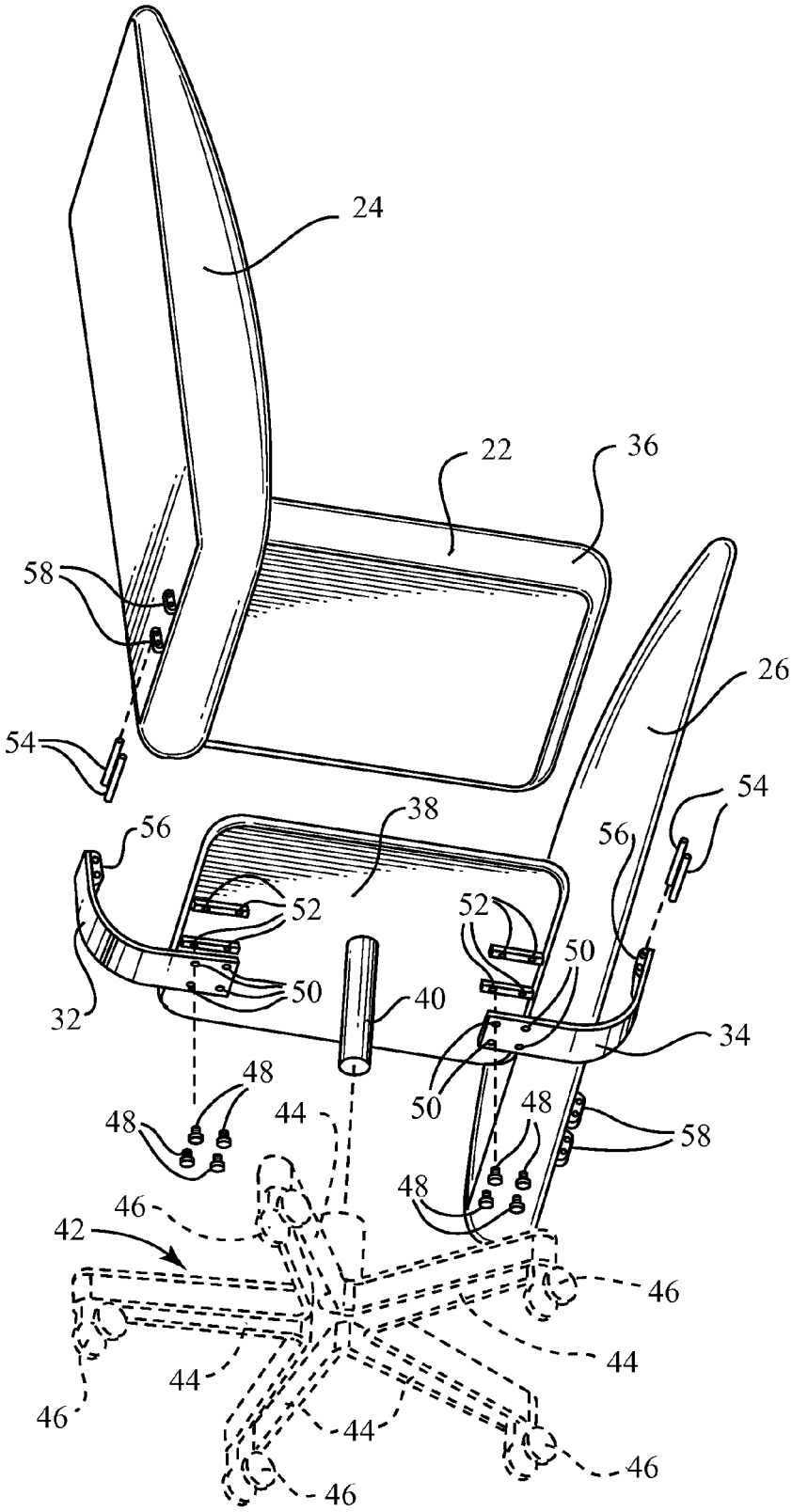
FIG. 4 is an exploded perspective view of the couple's chair of the present invention showing the parts thereof.
Figure 5:
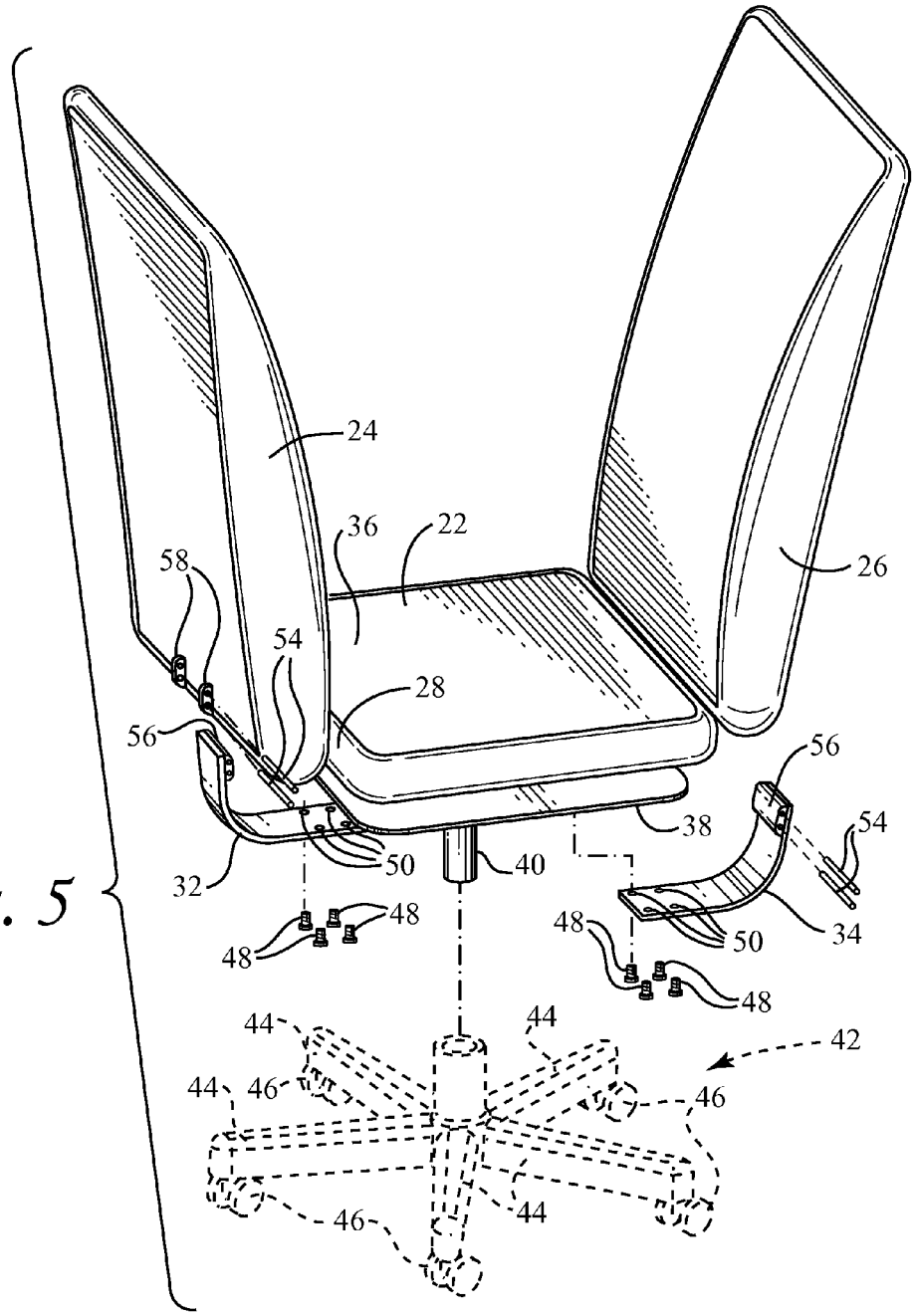
FIG. 5 is another exploded perspective view of the couple's chair of the present invention showing the parts thereof, similar to FIG. 4 but taken from a different observation point.
Figure 6:
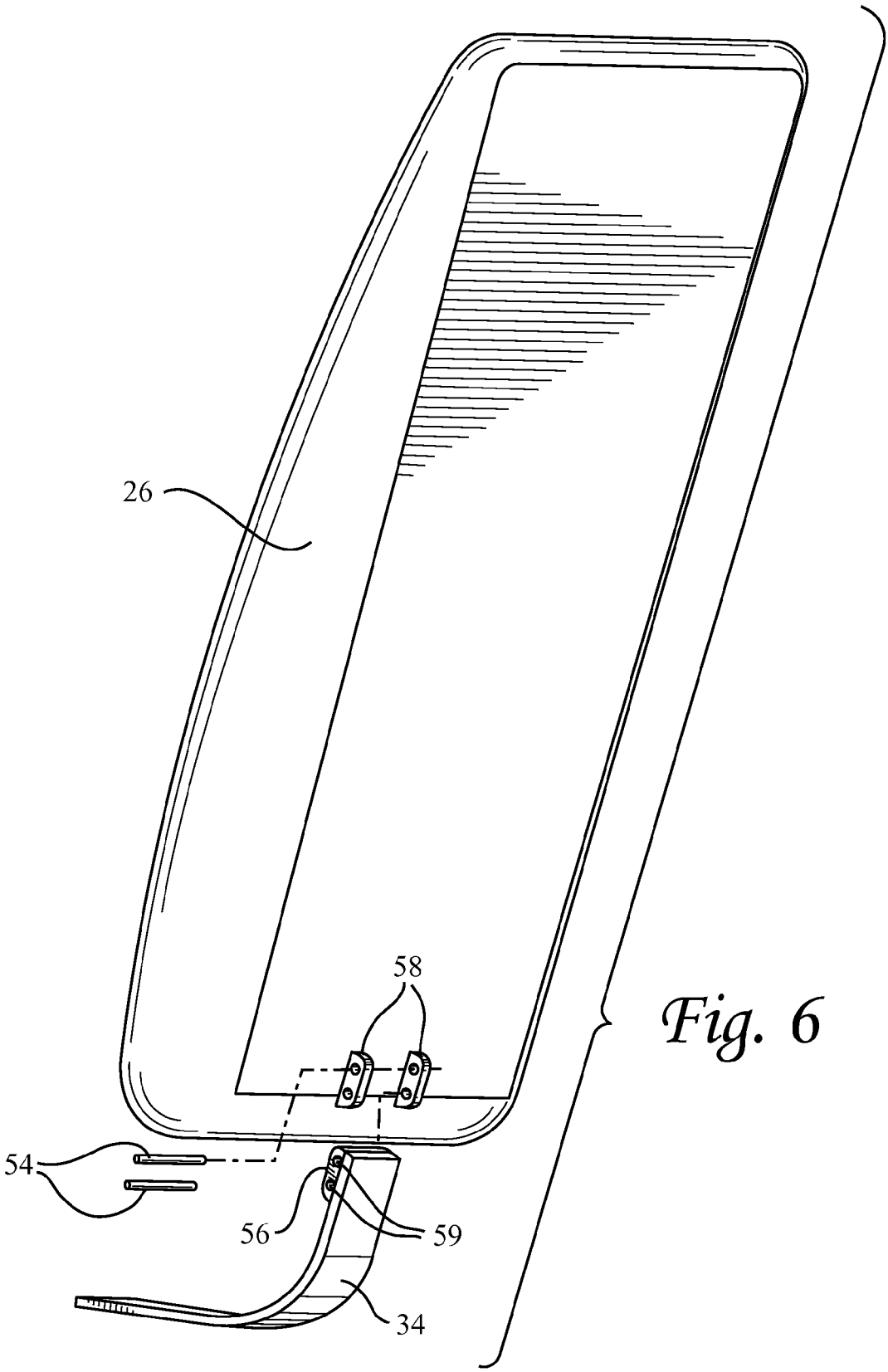
FIG. 6 is an exploded perspective view of a portion of the couple's chair of the present invention, showing detals of the attachment of the chair backrest to the chair backrest support.
Figure 7:
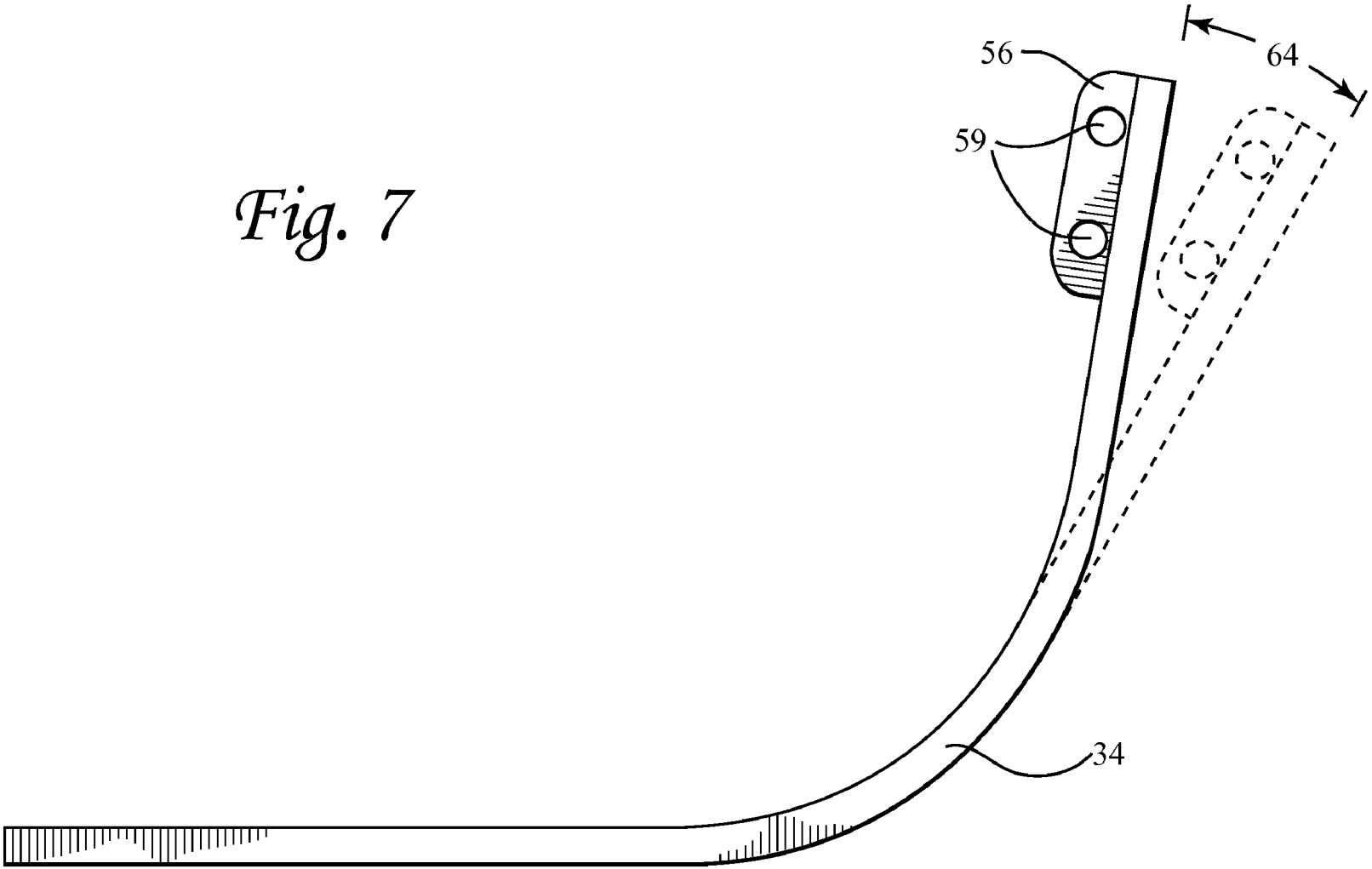
FIG. 7 is a side view of a chair backrest support, showing flexing thereof.

When respectively mounted to seat 22 by first and second backrest supports 32, 34 as shown and hereinbefore described, first and second backrests 24, 26 are reclineably movable from a substantially upright first position 60 to a reclined tilted second position 62 at an angle 64 with respect to first position 60 as best seen in FIG. 3, thereby permitting greater enjoyment of the conjoined seating position of the couple sitting in chair 20, as supports 32, 34 flex under the weight of the couple as best seen in FIG. 3.

To use the chair 20 of the present invention, one member of the couple, typically a man, sits in the chair with that member's back resting against one of the backrests 24, 26, and with that member's legs straddling the seat 22 of the chair, one leg on either side of the other backrest 26, 24. The other (second) member of the couple then sits in the first member's lap with the second member's legs also straddling the seat 22 with one leg on either side of the first member's body, with both members of the couple facing each other, with one backrest providing support for one member of the couple and with the other backrest providing support for the other member of the couple, as needed. As the couple rocks back and forth, the backrest supports allow the backrests to move through angle 64 and beyond, as desired, providing supporting pressure to the backs of the couple as needed.

Although the present invention has been described and illustrated with respect to a preferred embodiment and a preferred use therefor, it is not to be so limited since modifications and changes can be made therein which are within the full intended scope of the invention.

I claim:

1. A chair for supporting a couple, said chair comprising:

(a) a seat having a first lateral edge and having a second lateral edge opposed thereto;

(b) a first backrest and a second backrest, said first backrest being mounted to said seat and upstanding adjacent said first lateral edge, said second backrest being mounted to said seat and upstanding adjacent said second lateral edge, said first and second backrests each being movable from a substantially upright first position to a tilted second position at an angle with respect to said first position; said first backrest facing said second backrest with said seat therebetween when said first and second backrests are both in said substantially upright first position; and (c) a first backrest support mounting said first backrest to said seat and a second backrest support mounting said second backrest to said seat.

2. The chair as recited in claim 1, in which said first and second supports comprise a flexible piece of spring steel.

* * * * *